US005938144A

United States Patent [19]

Kaipf et al.

[11] Patent Number: 5,938,144

[45] Date of Patent: Aug. 17, 1999

[54] WINDING MACHINE

[75] Inventors: Walter Kaipf, Haunsheim; Jörg Maurer, Steinheim, both of Germany

[73] Assignee: Voith Sulzer Papiermaschinen GmbH, Germany

[21] Appl. No.: 09/104,800

[22] Filed: Jun. 25, 1998

[30] Foreign Application Priority Data

Jun. 25, 1997 [DE] Germany ..... 197 27 012

[51] Int. Cl.[6] ..... B65H 18/14

[52] U.S. Cl. ..... 242/530.4; 242/541.1; 242/541.3; 242/541.6; 242/541.7

[58] Field of Search ..... 242/530.4, 533, 242/541, 541.1, 541.3, 541.4, 541.5, 541.6, 541.7, 547

[56] References Cited

U.S. PATENT DOCUMENTS

| | | | |
|---|---|---|---|
| 2,743,065 | 4/1956 | Watkins . | |
| 3,098,619 | 7/1963 | Washburn | 242/541.3 |
| 3,941,055 | 3/1976 | Semmler et al. | 101/415.1 |
| 4,508,283 | 4/1985 | Beisswanger | 242/533 |
| 4,732,341 | 3/1988 | Ruff . | |
| 4,746,076 | 5/1988 | Tomma et al. | 242/541.3 |
| 4,842,209 | 6/1989 | Saukkonen . | |
| 4,867,387 | 9/1989 | Schonmeier | 242/541.6 |
| 4,883,233 | 11/1989 | Saukkonen et al. | 242/541.3 |
| 4,921,183 | 5/1990 | Saukkonen et al. | 242/541.3 |
| 4,932,599 | 6/1990 | Doerfel | 242/530.4 |
| 5,022,597 | 6/1991 | Morizzo | 242/541.5 |
| 5,150,850 | 9/1992 | Adams | 242/541.3 |
| 5,165,618 | 11/1992 | Ruff | 242/530.4 |
| 5,275,345 | 1/1994 | Stahl et al. | 242/547 |
| 5,360,180 | 11/1994 | Welp et al. | 242/530.4 |
| 5,364,044 | 11/1994 | Welp et al. | 242/530.4 |
| 5,405,100 | 4/1995 | Cooper et al. | 242/541.3 |
| 5,518,199 | 5/1996 | Welp et al. | 242/530.4 |
| 5,632,456 | 5/1997 | Kruger | 242/541.5 |
| 5,639,045 | 6/1997 | Dorfel | 242/527 |
| 5,732,902 | 3/1998 | Tomma et al. | 242/530.4 |
| 5,820,063 | 10/1998 | Fissmann et al. | 242/530.4 |
| 5,823,463 | 10/1998 | Fissmann et al. | 242/541.7 |

FOREIGN PATENT DOCUMENTS

| | | |
|---|---|---|
| 2082373 | 10/1971 | France . |
| 2313943 | 9/1974 | Germany . |
| 2808168 | 8/1979 | Germany . |
| 3327972 | 2/1985 | Germany . |

OTHER PUBLICATIONS

German Abstract, 98108285.2.

*Primary Examiner*—John P. Darling
*Attorney, Agent, or Firm*—Ostrolenk, Faber, Gerb & Soffen, LLP

[57] ABSTRACT

A winding machine for a material web, particularly of paper or cardboard, the web being rolled onto a reel core for forming at least one round reel. At least two supporting devices support the wound reel. The first supporting device is formed by a first supporting roller. The second supporting device comprises at least a second supporting roller and comprises at least one lowering device that lowers to let the wound reel move off the first roller. The lowering device can be pivoted about an axis that runs essentially parallel to the longitudinal axis of the first roller. The second supporting device is moveable to a first position where it supports the winding on process or a second position where it provides support over a circumferential area of the reel during the remainder of the winding. The second supporting device is moveable, e.g., by a piston-cylinder unit, to provide support as the wound reel increases in diameter. The second support device is preferably integrated in or is part of the lowering device and moves with the lowering device to move out of the way of the reel moving out.

21 Claims, 5 Drawing Sheets

WINDING MACHINE

BACKGROUND OF THE INVENTION

The invention relates to a winding machine for a material web, in particular a paper web or board web, and particularly relates to the supporting device for the reel being wound and to moving the wound reel out of the machine.

Winding machines of the type mentioned here are known, as in DE 35 41 906 C1 which corresponds to U.S. Pat. No. 4,732,341. They are used to manufacture a wound reel of a material web. The devices comprise at least two supporting devices which support the wound reel during the winding-on process. A first supporting device is formed by a central supporting roller. A second supporting device is formed by a carrying roller. The supporting roller and the carrying roller form a winding bed on which the wound reel rests during winding-on.

To move the finished wound reel out, the known winding machine has an ejection apparatus and has a lowering device which can be pivoted about an axis which runs parallel to the longitudinal axis of the supporting roller. The wound reel is pressed out of the winding bed by the ejection apparatus, and is moved out by pivoting of the lowering device. The known winding machine is disadvantageous in that its design is complex and high cost. Furthermore, it requires a relatively large amount of space, which gives rise to additional costs.

SUMMARY OF THE INVENTION

The object of the invention is to provide a winding machine which does not have the above disadvantages and which enables winding on and wound roll ejection.

In order to achieve this object, the invention concerns a winding machine for a material web, particularly a paper web or a cardboard web, wherein the web is rolled onto a reel core for forming at least one round reel. At least two supporting devices support the wound reel. The first supporting device is formed by a first supporting roller. The second supporting device comprises at least a second supporting roller and further comprises at least one lowering device that lowers to move out the wound reel off the first roller. The lowering device can be pivoted about an axis that runs essentially parallel to the longitudinal axis of the first roller.

The second supporting device can assume at least two functional positions. In the first position, it supports the winding on process. In the second functional position, it provides support over a circumferential area of the wound reel during the remainder of the winding of the wound reel. In the second functional position, the finished wound reel can be moved out from the winding machine by the lowering device. This makes it possible to dispense with a separate ejection apparatus for moving the wound reel out from the winding bed. As a result, the design of the winding machine is made simpler. Relatively large wound reel diameters can be realized. The second supporting device is moveable by appropriate moving devices, e.g., piston-cylinder units, to provide the respective support as the wound reel increases in diameter. The second supporting device is preferably integrated in or is part of the lowering device and moves with the lowering device to move out of the way of the reel moving out. This provides a compact, and space saving design.

In an exemplary embodiment of the winding machine, the second supporting device is designed as a strain relief module. It comprises at least two supporting rollers around which at least one continuous supporting belt is guided. The strain relief module thus makes it possible to provide both initial linear support and later circumferential area support to the wound reel over an area. The linear support is realized by applying at least one of the supporting rollers of the strain relief module to the wound reel, while the support or strain relief over an area is applied by pressing a supporting belt section against the wound reel. Support over a circumferential area reliably avoids a hard nip and avoids capturing air under the top wound layer of the wound reel, which can lead to problems during the winding process, in particular with sensitive material webs.

A further embodiment includes an actuator drive in the strain relief module which presses at least one of the supporting rollers and/or a supporting belt section lying between the supporting rollers against the wound reel. The entire strain relief module, or one of the supporting rollers, or the supporting belt section can be displaced with respect to the lowering device in order to provide strain relief to the wound reel. The degree of support provided to the wound reel by the strain relief module during the winding process can be increased as the wound reel diameter, and thus the weight of the reel, becomes larger. As a result, the forces and stresses in the winding gap can be influenced in a defined manner. A soft nip is realized by applying the supporting belt section lying between the supporting rollers to the circumference of the wound reel. Strain relief is provided over an area here. As a result, the stresses acting on the material web in the winding gap or winding region between the wound reel and the supporting belt section can be reduced.

In a particularly preferred embodiment, the proportion of the wound reel weight which is supported by the strain relief module over an area becomes greater as a function of the weight of the wound reel, while the linear support of the wound reel by means of the first supporting device becomes smaller. In other words, the planar support provided to the wound reel increases as the weight of the wound reel becomes greater, while the linear support is reduced to a specific degree.

Furthermore, in a preferred exemplary embodiment of the winding machine, at least one supporting roller of the strain relief module and/or the supporting belt can be driven. This enables the supporting rollers and the supporting belt to be speeded up to the running speed of the material web and to be driven at the same speed as the wound reel during the provision of strain relief to the reel. This overcomes the inertia forces and frictional forces of the supporting rollers and of the supporting belt of the strain relief module. As a result, when one of the supporting rollers bears against the wound reel, linear force effects acting in the winding gap can be prevented, and when the supporting belt section bears against the wound reel, peripheral force effects acting on the wound reel can be prevented. This virtually excludes damage to the wound reel layers which could cause the material web to tear. However, it is also possible to drive the supporting rollers and the supporting belt more quickly or more slowly than the wound reel. This applies a peripheral force, which influences the winding result to the wound reel in the winding gap. The forces which are caused by the relative speed between the wound reel and the supporting rollers or the supporting belt of the strain relief module and which act on the circumference of the wound reel, enable the stresses in the winding gap/winding region between the second supporting device and the wound reel to be influenced, and preferably adjusted.

Furthermore, in a further preferred embodiment of the winding machine, the pivot axis of the lowering device coincides with the longitudinal axis of the supporting roller of the first supporting device. The lowering device and the second supporting device are therefore arranged or mounted at the same point within the winding machine, so that the complexity of the bearing system, and thus the design of the winding machine, can be further simplified.

Finally, a preferred embodiment of the winding machine includes a drive, preferably a central drive, assigned to the wound reel. The drive force or torque is therefore applied to the reel core. This drive makes it possible to influence or adjust the forces and stresses acting in the winding gap between the wound reel and the supporting roller of the first supporting device, the forces and stresses acting in the winding gap between the wound reel and the second supporting device, and the core torque, and thus the stress in the core, providing an overall improvement in the winding result.

Other features and advantages of the present invention will become apparent from the following description of the invention which refers to the accompanying drawings.

DETAILED DESCRIPTION OF THE INVENTION

Figure 1:
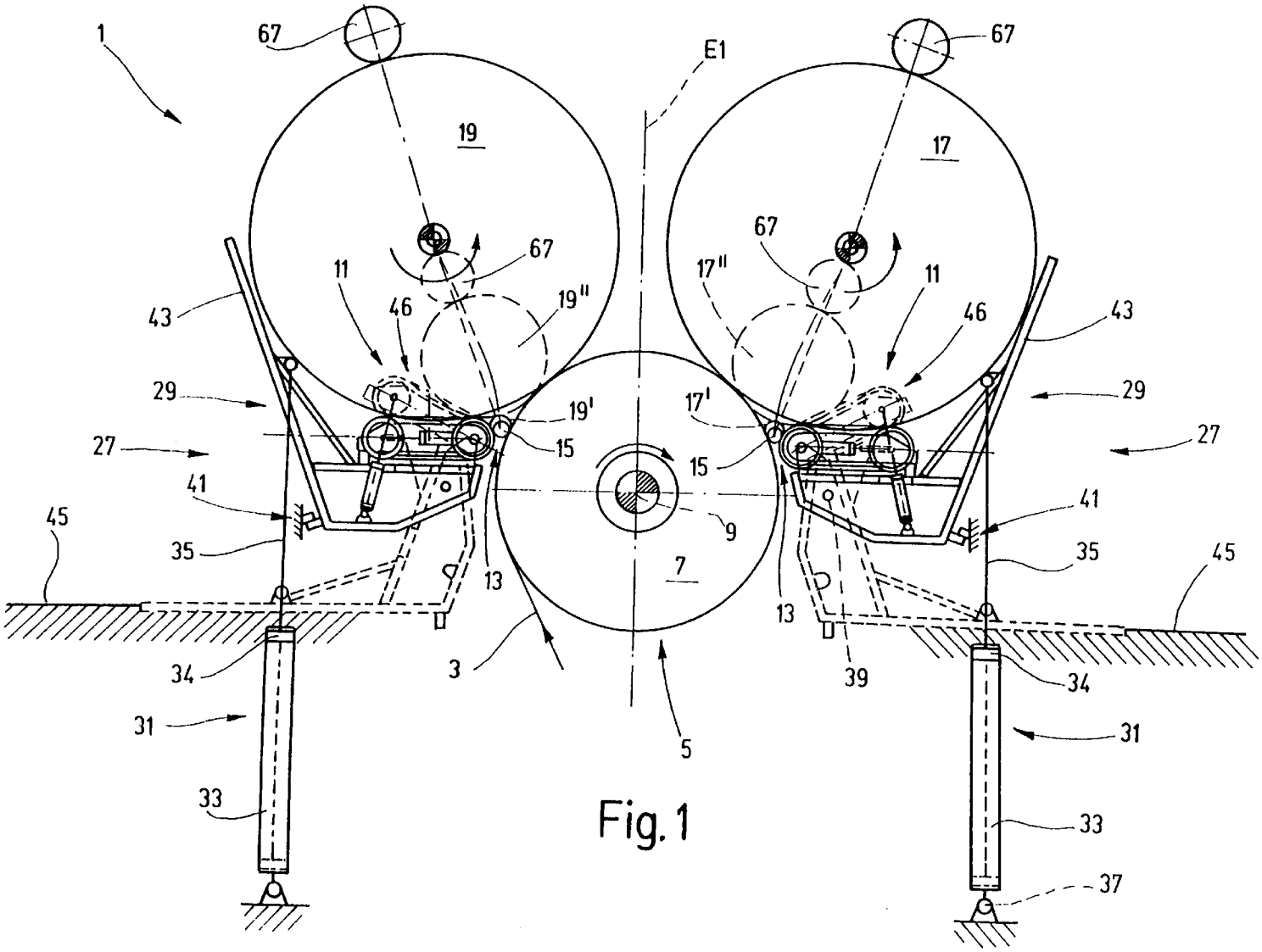
FIG. 1 shows a schematic cross section of a first embodiment of a winding machine having a first variant embodiment of the second supporting device.

FIG. 1 shows a schematic cross section of a first embodiment of a winding machine 1 according to the invention for a winding material web 3. It comprises a first supporting device 5 which is implemented as and comprises a supporting roller 7. The longitudinal axis 9 of the supporting roller 7 lies on an imaginary first vertical plane E1 which extends in the plane of the image of FIG. 1. On each of the sides of the supporting roller 7, that is, to the left and right of the plane E1, a respective second supporting device 11 is arranged. Each of the devices 11, together with the supporting roller 7 of the first supporting device 5, form a respective winding bed 13 into which reel cores 15 are inserted.

Arranged in front of or upstream of the winding machine 1, as viewed in the running direction of the material web 3, there is a longitudinal cutting device (not illustrated), which cuts the material web 3 longitudinally into narrower width strips. The material web strips are fed to the winding machine 1 from below and are led over part of the circumference of the driven supporting roller 7 of the first supporting device 5. The material web strips are wound on to the reel cores 15 to form wound reels, of which only the wound reels 17 and 19 are illustrated in FIG. 1. The number of reel cores 15 which are lined up flush in the winding beds 13 may correspond to the number of material web strips which are cut off from the material web 3, i.e., one or more of the cut strips may be wound on each core. Block winding is also possible, that is, at least two material web strips are wound on to a common reel core, and it is possible to cut them off at the joint between the material strips after the winding process. The number of reel cores may therefore also be smaller than the number of material web strips.

Figure 4:
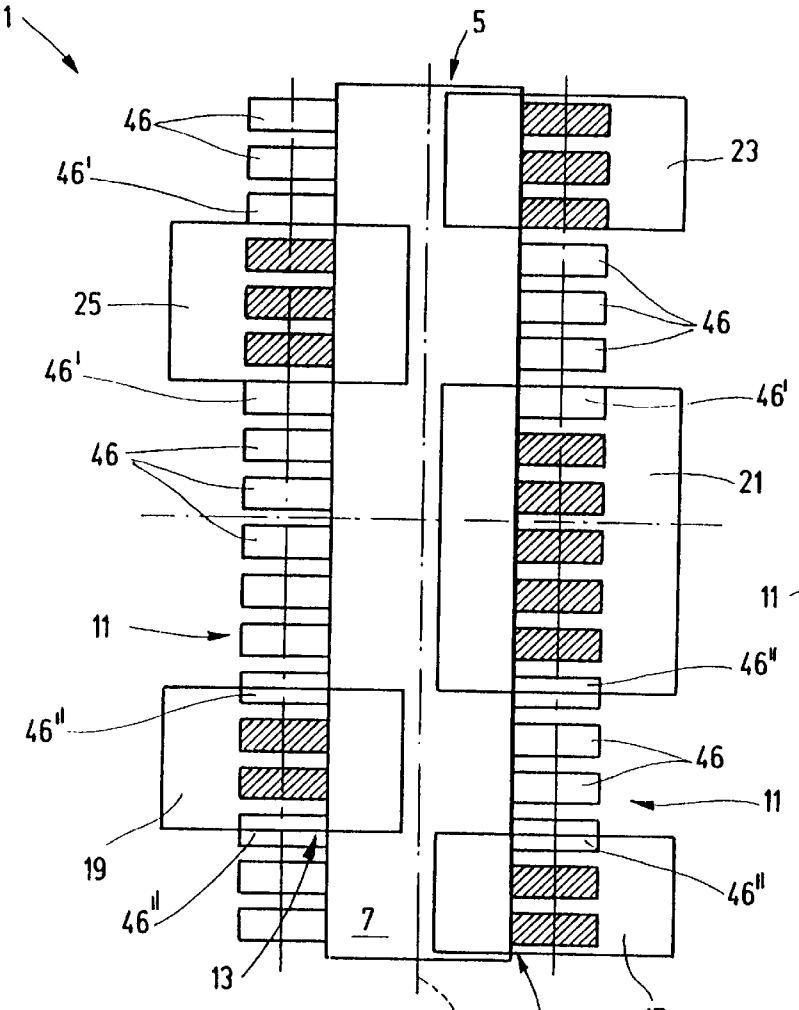
FIG. 4 shows a schematic plan view of the winding machine in FIG. 1.

FIG. 4 shows a schematic plan view of the winding machine 1 in FIG. 1. In addition to the wound reel 17, further wound reels 21 and 23 may be wound in the winding bed 13 lying to the right of the plane E1. The wound reels 17, 21, 23 are arranged at a distance from one another and may have different respective widths, the wound reels 17 and 23 being shown of identical width here. In another exemplary embodiment, the wound reels 17, 23 may have different widths. In the winding bed 13 to the left of plane E1, the wound reel 19 is wound on, and at a distance a further wound reel 25 is wound on. The wound reel 19 lies opposite the intermediate space between the wound reels 17, 21 arranged in the right-hand winding bed 13 at a distance from one another, and the wound reel 25 lies opposite the space between the wound reel 21 and the wound reel 23. The material web strips which lie next to one another and which are wrapped around the supporting roller 7 may be alternately fed to the left-hand and right-hand winding beds 13.

The reel cores 15 which are inserted into the winding beds 13 are in each case guided during the winding process by one guiding device (not illustrated). The guiding device is of displaceable design, in order to compensate for the growth in diameter of the wound reel and to guide and provide strain relief to the wound reel which becomes heavier as its diameter increases. As a result, the forces and stresses in the winding gaps formed between the first supporting device 5 and the second supporting device 11 can be adjusted to a desired value. Furthermore, each wound reel 17, 19, 21, 25, 23 may be assigned a central drive (not illustrated), which applies a drive force or a drive torque to the reel core.

In FIG. 1, the winding machine 1 is of identical design on both sides of the plane E1. Therefore, in this exemplary embodiment, the plane E1 is a mirror plane. Only the devices of the winding machine 1 to the right of the plane E1 are explained in detail. The second supporting device 11 is arranged on a lowering device 27 which comprises a bent, essentially channel shaped, bar 29, which extends longitudinally essentially over the entire width of the winding machine 1. An actuator drive 31 comprising a piston/cylinder unit and including a cylinder 33 and a piston rod 35 connected to a piston 34, is assigned to the lowering device 27. The cylinder 33 is fixedly connected at one end to part of the winding machine 1 and is mounted in a pivotable fashion about a shaft 37 which runs essentially parallel to the longitudinal axis 9 of the supporting roller 7. The piston rod 35, which is guided in the cylinder 33, is pivotally connected at one end to the lowering device 27 which, when the actuator drive 31 is activated, is pivoted about a shaft 39 which runs essentially parallel to the longitudinal axis 9 of the supporting roller 7. The shaft 39 is located underneath the wound reel 17 and to the right of the supporting roller 7.

When the piston rod 35 moves outward or upward, the lowering device 27 is pivoted counter clockwise about the shaft 39. Its pivot range is limited by a stop 41. When the piston rod 35 moves into the cylinder 33 or downward, the lowering device 27 is pivoted clockwise until the lowering device 27 wall 43 strikes against a delivery surface 45 of the winding machine 1 or rests on it. Basically, any selected actuator drive 31, for example, an electric motor, or the like, coupled to mechanical transmission means can pivot the lowering device 27. The lowering device 27 and the second supporting device 11 are explained with reference to FIG. 2.

Figure 2:
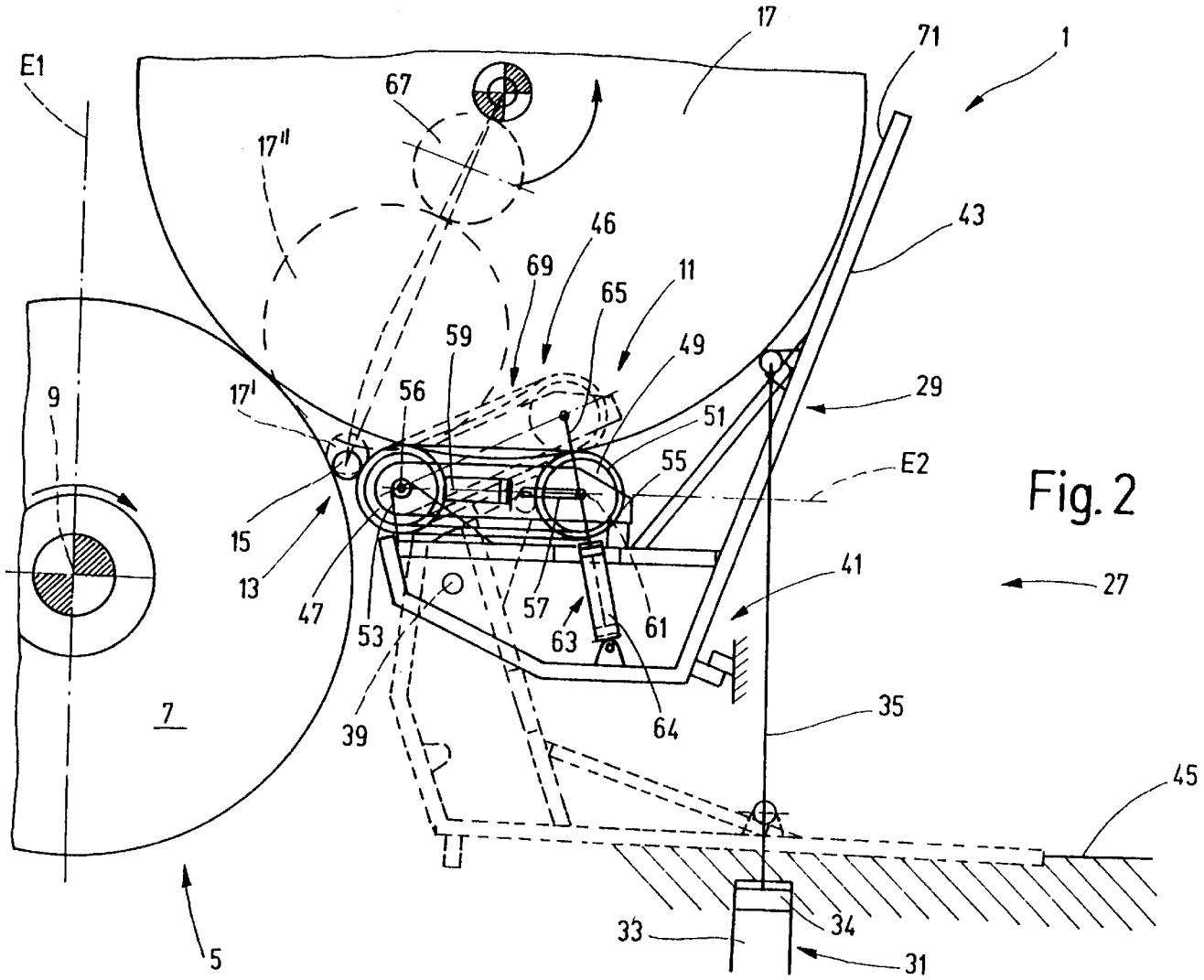
FIG. 2 shows a detail of the winding machine in FIG. 1 on a highly enlarged scale.

FIG. 2 shows a detail, to the right of the plane E1, of the winding machine 1 on a greatly enlarged scale. Identical parts have the same reference symbols, as described relating to FIG. 1. The second supporting device 11 comprises a strain relief module 46, comprising two supporting rollers 47 and 49, around which a continuous supporting belt 51 is wrapped. The supporting roller 47 is fixedly connected to the lowering device 27 via a bearing device 53 (also referred to as a pillow block) and can be driven by a drive (not illustrated), for example a motor arranged at the end side or an external rotor motor. "Fixedly" is here understood as a bearing which prevents translatory movement while permitting rotary movement. A carrier plate 55 is mounted in a pivotable fashion about the axis of rotation 56 of the supporting roller 47. The other supporting roller 49 of the strain relief module 46 is displaceably mounted in a guide 57 which is implemented as an elongated hole in the plate 55. A tensioning device 59 is arranged between the supporting rollers 47, 49 and is implemented in this embodiment as a piston/cylinder unit which adjusts the tension of the supporting belt 51. The tensioning device 59 can adjust the distance between the axis of rotation 61 of the supporting roller 49 and the axis of rotation 56 of the supporting roller 47 for adjusting the tension of the supporting belt.

An actuator drive 63 assigned to the strain relief module 46 comprises a piston/cylinder unit. Like the actuator drive 31, the actuator drive 63 can be of any desired design, for example an electric motor coupled to a mechanical transmission mechanism, or a hydraulic motor, which is also referred to as an oil engine. The actuator drive 63 comprises a cylinder 64 and a piston rod 65 guided in the cylinder. The cylinder 64 is attached to the lowering device 27 so as to be capable of rotation, while the piston rod 65 is connected to the carrier plate 55 in the region of the axis of rotation 61 of the supporting roller 49. When the piston rod 65 moves outward or upward, the carrier plate 55, and thus the supporting roller 49, are pivoted or swung counterclockwise about the axis of rotation 56 of the supporting roller 47, whereas they are pivoted clockwise when the piston rod 65 moves inward or downward. Dashed lines represent the positions of the supporting belt 51, the supporting roller 49 and the carrier plate 55 when the piston rod 65 is extended.

The function of the lowering device 27 and of the second supporting device 11 are explained with reference to a single wound reel 17. Before the material web 3 or a strip cut off from reel 17 is wound on, the lowering device 27 and the second supporting device 11, that is the strain relief module 46, are moved into their initial positions, illustrated in FIGS. 1 and 2 by continuous lines. In this position, the lowering device 27 has been pivoted counter clockwise as far as the stop 41, causing the second supporting device 11 to assume a first functional position. Before the winding process starts, the piston rod 65 of the actuator drive 63 is retracted, such that the axes of rotation 56, 61 of the supporting rollers 47, 49 lie in an imaginary second plane E2 (which is indicated by dot-dash lines), arranged approximately horizontally, for example. The plane E2 can also be easily positioned at an angle with respect to the supporting roller, designated also as the central roller, that is, they can enclose an acute angle with the horizontal and drop away to the left (in FIG. 2). The supporting roller 47 of the second supporting device 11 acts together with the supporting roller 7 of the first supporting device 5 to form the winding bed 13 into which the reel core 15 is inserted.

At the start of the winding process, a loading roller 67 (indicated by dashed lines in FIG. 2) presses the reel core 15 or, as the winding on process proceeds, the wound reel 17 into the winding bed 13 with a defined force, specifically until the intrinsic weight of the wound reel 17 is sufficient to set a desired linear force in the roller nip between the supporting roller 7 and the wound reel 17, and between the wound reel 17 and the second supporting device 11.

FIGS. 1 and 2 show the wound reel 17 indicated by dashed lines, show the reel 17' just after the free end of the material web 3 has been wound onto the reel core 15, and show the reel 17" during the winding process. As the diameter of the wound reel 17 increases, the supporting roller 49 of the second supporting device 11 is pivoted counter clockwise about the axis of rotation 56 of the supporting roller 47 by the actuator drive 63, specifically to such an extent that, starting from a prescribed diameter of the wound reel 17, the reel is transferred from a supporting belt section 69 that lies between the supporting rollers 47, 49, and the reel is relieved of strain during the remainder of the winding process. The wound reel 17 which previously bore against the supporting roller 47 is relieved of strain or is supported now only by the supporting belt section 69 which is in contact over a circumferential region of the wound reel 17. In FIGS. 1 and 2, the supporting roller 49 and the supporting belt 51 are shown by dashed lines in the position in which the wound reel 17" is relieved of strain by the supporting belt section 69. As the diameter of the wound reel 17" increases following initial contact with the belt section 69, the supporting roller 49 is pivoted by the actuator drive 63 in a clockwise direction such that virtually only the supporting belt section 69 bears against the circumference of the wound reel 17, and the reel does not only run up onto the supporting roller 49. The forces and stresses acting in the circumferential region at which the supporting belt section 69 of the second supporting device 11 bears against the wound reel 17 can be adjusted by varying the tension on the supporting belt 51. The greater is the tension of the supporting belt, the smaller is the circumferential region of the reel over which the supporting belt section 69 bears against the wound reel 17, and vice versa for lower tension. Given the same contact forces, a small circumferential region leads to a larger surface pressure.

In another exemplary embodiment, there is provision for the piston rod 65 of the actuator drive 63 to be extended in order to wind onto the reel core 15, so that the strain relief module 46 is moved into the position illustrated by dashed lines in FIG. 2. The material web 3 is wound onto the reel core 15 inserted into the winding bed 13 so as to form the wound reel 17. Starting from a defined diameter of the wound reel (see wound reel 17" in FIG. 2), the wound reel runs against the supporting belt section 69 of the second supporting device 11, so that the support provided to the wound reel by means of the second supporting device 11, which support has been linear over the axial width of the reel until then, changes into a support over an arcuate, circumferential area. As the diameter of the wound reel 17 increases, the supporting roller 49 of the second supporting device 11 is continuously pivoted about the axis of rotation 56 of the supporting roller 47 by a retraction movement of the piston rod 65 of the actuator drive 63, until the final diameter of the wound reel 17 is obtained. Operation of the actuator drive 63 enables a desired degree of support or of strain relief of the wound reel 17 to be set and thus enables adjusting the magnitude of the linear force acting in the winding gap between the wound reel 17 and the supporting roller 7 of the first supporting device 5.

After the wound reel 17 has been completely wound, the lowering device 27 is activated by the piston rod 35 of the actuator drive 31 moving into the cylinder 33. This pivots the lowering device 27 clockwise about the shaft 39. The strain relief module 46 or the second supporting device 11 is pivoted back into the position illustrated by continuous lines in FIG. 2, during the winding process and completion of the wound reel 17. That module is also pivoted by the lowering device 27 being pivoted specifically into a second functional position in which the finished wound reel 17 is moved out. During the pivoting of the lowering device 27, the wound reel 17 bears against a supporting wall 71 of the lowering device 27 which runs parallel to the wall 43 of the lowering device 27. When the lowering device 27 reaches a defined position in which its supporting wall 71 has a specific angle of inclination with respect to the delivery surface 45 of the winding machine 1, the wound reel 17 rolls automatically out of the lowering device 27, without a force having to be applied to the wound reel 17 from outside.

FIG. 4 shows a schematic plan view of the winding machine 1 in accordance with FIG. 1 during the winding on of the wound reels 17, 19, 21, 25, 23. It shows that the second supporting device 11 is formed of a number of strain relief modules 46, which are arranged at a distance from one another and which each extend over a relatively narrow, but equally large width region of the winding machine 1. The strain relief modules 46 are identical in design to the strain relief module 46 described with reference to FIG. 2.

In another advantageous embodiment of the invention, the maximum width of a strain relief module is smaller than the width of the shortest wound reel. "Width" is understood in this context as the longitudinal or axial extent of the strain relief module, that is, of the supporting belt 51 and/or of the supporting rollers 47, 49 in the direction of the longitudinal extent of the wound reels. The strain relief modules 46 are all arranged on the lowering device (not illustrated in FIG. 4). The activated strain relief modules 46, those which provide strain relief to the wound reels 17, 19, 21, 25, 23 during the winding process, are represented by hatching. The other ones of the strain relief modules then in an area of action where none of the wound reels 17, 19, 21, 25, 23 is arranged, and the strain relief modules which directly adjoin the edge of a wound reel (strain relief modules 46') or overlap the edge of a wound reel (strain relief modules 46") are deactivated. In the deactivated state, the piston rod 65 of the actuator drive 63 which is assigned to the respective strain relief module is in the retracted state. In their deactivated state, the strain relief modules therefore do not contribute to the strain relief of a wound reel.

Irrespective of whether a strain relief module is activated or deactivated, the supporting belt 51 and/or at least one of the supporting rollers 47, 49 can be driven by a drive (not illustrated). Deactivation of the strain relief modules 46', 46" located in the edge region of a wound reel enables excessively high local stressing of the wound reels to be avoided. In another embodiment, the strain relief modules 46', 46" can also be activated to provide strain relief to the respective wound reel.

The strain relief modules 46 of the second supporting devices 11 of the winding machine 1 can be activated and deactivated either jointly or also independently of one another. Also, the strain relief modules 46 of the two second supporting devices 11 which are arranged to the left and right of the plane E1 may be controlled jointly. It becomes clear that the strain relief modules 46 can therefore also be coupled to operate in a selected timed relationship or can be coupled mechanically.

An exemplary embodiment of the winding machine 1 drives the supporting rollers 47 of the strain relief modules 46, 46', 46" jointly, that is, the supporting rollers 47 of the strain relief modules are coupled together, so that during the entire winding process, both the strain relief modules which are used to support the wound reel and the deactivated strain relief modules are driven. Coupling of the strain relief modules to one another enables their being driven by a drive, for example, an electric motor, which enables the design of the winding machine 1 to be simplified. In another embodiment, each strain relief module 46 is assigned a respective separate drive. Here, preferably all the strain relief modules 46, 46', 46" are driven until the wound reel is of such a size that it no longer bears against the supporting rollers 47 of the strain relief modules 46', 46", which are deactivated during the rest of the winding process and do not serve to support the wound reel over an area.

All of the above shows that the design of the winding machine 1 can be simplified by arranging the second supporting device 11 on the lowering device 27 which serves to move out the wound reel or reels. The winding machine 1 can be used to wind individual webs of a material web. However, it is also possible to employ the winding machine 1 to wind a single continuous material web, for example, in conjunction with a paper machine.

It is also possible for the first supporting device 5 to be assigned a second supporting device 11 on only one side of the plane E1. In such an embodiment of the winding machine 1, merely one winding bed is provided in which the wound reels or reel cores lie. The reel cores can bear directly one against the other, side by side, so that material web strips cut off by a longitudinal cutting device arranged in front of the winding machine are wound on, for example, in a so called block winding, to form wound reels. In addition, it is possible for reel cores, which bear one against the other, to be connected by means of at least one inserted winding bar or tube to virtually form a reel core. This enables the means of guiding the reel cores to be made less complex.

Figure 3:
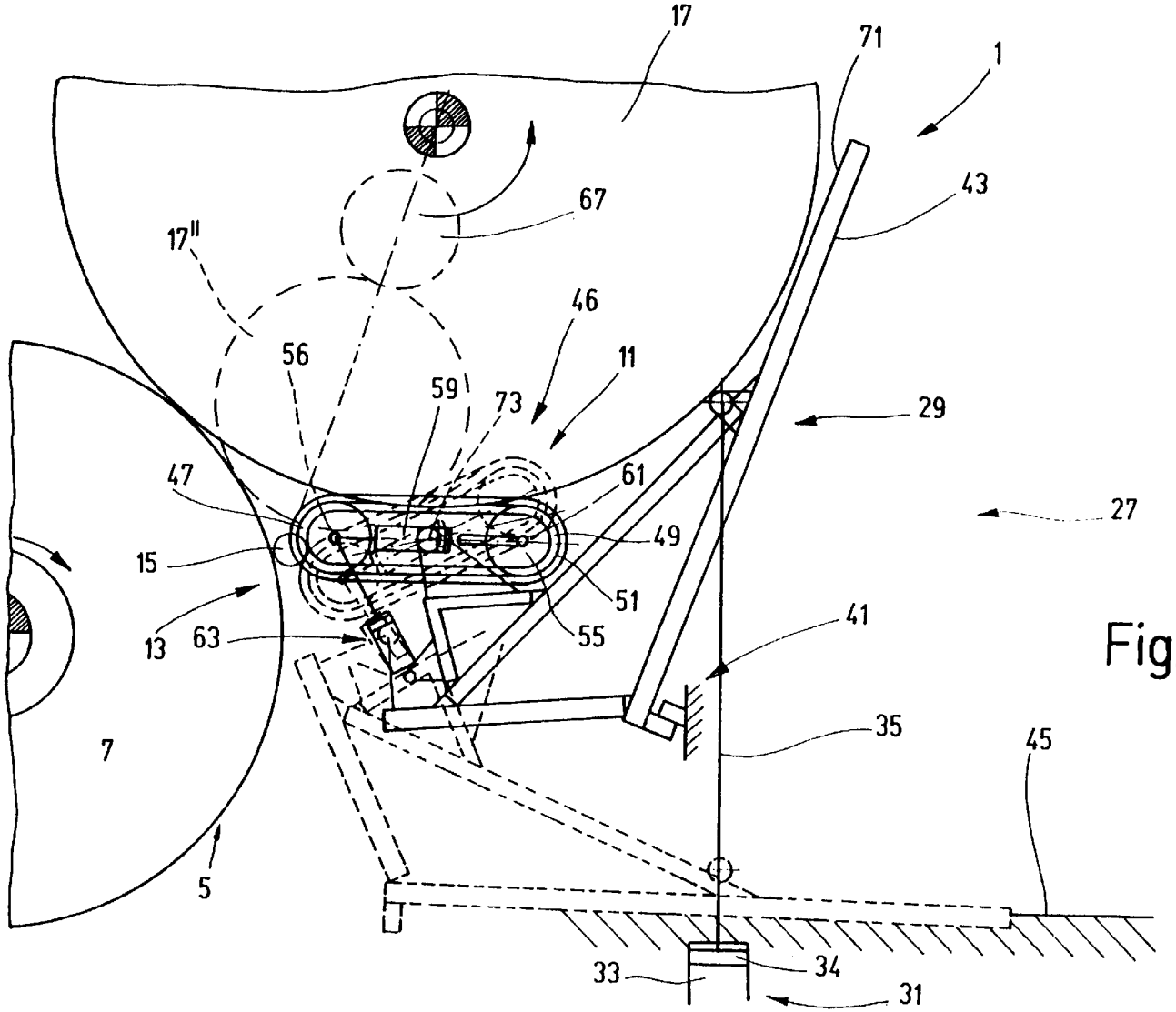
FIG. 3 shows a detail of a further embodiment of the winding machine, with a second variant embodiment of the second supporting device.

FIG. 3 shows a schematic view of a detail of a further embodiment of the winding machine 1 in cross section. Parts corresponding to those in FIGS. 1, 2 and 4 have identical reference symbols. Details are provided on the differences only. The lowering device 27 in FIG. 3 is guided by a guiding device (not illustrated) such that during retraction of the piston rod 35 of the actuator drive 31, the lowering device 27 carries out both a rotary and a translatory movement. It rotates about an axis parallel to the longitudinal axis 9 of the supporting roller 7 of the first supporting device 5. The translatory movement superimposed on the rotary movement of the lowering device 27 enables the space required for the lowering device 27 to pivot to be reduced and improves the moving out of the finished wound reel.

The second supporting device 11, which is designed as a strain relief module 46 mounted to be rotatable about an axis 73, is arranged on the lowering device 27. The axis 73 lies here between the axes of rotation 56, 61 of the supporting rollers 47 or 49 and is at essentially the same distance from both axes of rotation. Alternatively, the axis of rotation 73 of the strain relief module 46 may be at a larger or a smaller distance from the axis of rotation 56 of the supporting roller 47 than from the axis of rotation 61 of the supporting roller 49. The actuator drive 63 is permanently connected to the lowering device 27. Its piston rod 65 is connected by its free end in the region of the axis of rotation 56 of the supporting roller 47 to the strain relief module 46. During extension of the piston rod 65 out of the cylinder 64, the entire strain relief module 46, or at least the parts directly providing strain relief to the wound reel 17, namely the supporting belt 51 and the supporting rollers 47, 49, are pivoted clockwise.

During retraction of the piston rod 65 of the actuator drive 63, the strain relief module 46 rotates counter clockwise, and the wound reel is provided with support over an area during the entire rotation of the strain relief module 46.

To wind on a material web 3, the lowering device 27 is pivoted, by extending the piston rod 35 of the actuator drive 31, into an end position which is defined by the stop 41 and which is represented in FIG. 3 by continuous lines. This pivots the second supporting device 11 which is connected to the lowering device 27, into the first functional position. To form the winding bed 13 together with the supporting roller 7 of the first supporting device 5, the strain relief module 46 is moved into the position illustrated by dashed lines in FIG. 3, by retracting the piston rod 65 of the actuator drive 63. At least one reel core 15 is installed in the winding bed 13 formed between the supporting roller 7 and the supporting roller 47. It is possible for the reel core 15 to be driven by one central drive during the winding on of the material web 3 or of the material web strips cut off by a longitudinal cutting device arranged in front of the winding machine 1 and to be guided in each case by one guide device. The free end of the material web 3 is wound onto the reel core 15, and the linear force in the winding gap between the wound reel 17 and the supporting rollers 7, 47 is applied by the loading roller 67.

Strain relief is provided to the wound reel 17, which becomes heavier as its diameter increases. The strain relief module 46, namely the supporting rollers 47, 49 and the supporting belt 51, is rotated. Starting from a prescribed, for example adjustable, wound reel diameter, about the axis of rotation 73, the module 46 is rotated clockwise by the actuator drive 63, so that the supporting belt section 69 lying between the supporting rollers 47, 49 bears against the wound reel 17 and supports the reel over an area, or provides strain relief thereto, over a circumferential region of the reel during the rest of the winding process. When the end diameter of the wound reel 17 is reached, the strain relief module 46 has arrived in the position illustrated by continuous lines in FIG. 3.

To move the finished wound reel 17 onto the delivery surface 45 of the winding machine 1, the lowering device 27 is then pivoted clockwise by retraction of the piston rod 35 of the actuator drive 31. This simultaneously moves the second supporting device 11 into its second functional position. The pivoting of the supporting wall 71 of the lowering device 27 inclines the wall 71 in the direction of the delivery surface 45 of the winding machine 1 so that the wound reel 17 rolls out of the lowering device 27 without requiring action from outside.

Figure 5:
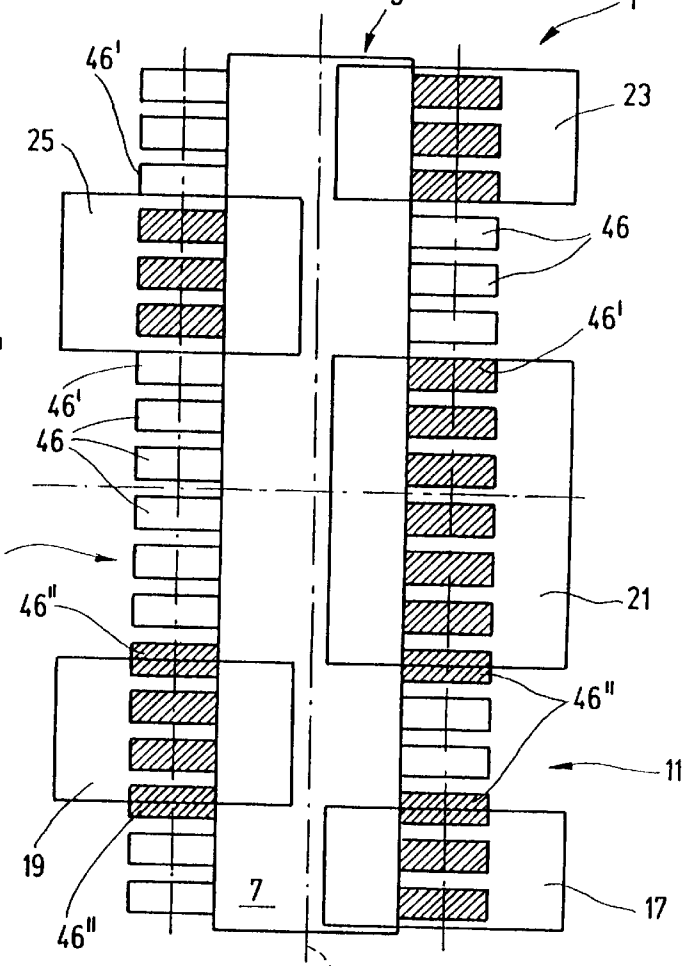
FIG. 5 shows a schematic plan view of the winding machine in FIG. 3, and FIGS. 6 and 7 show a detail of a third embodiment of the winding machine, with a third variant embodiment of the second supporting device.

FIG. 5 is a schematic plan view of the winding machine 1 in FIG. 3. The second supporting device 11 is formed with a number of strain relief modules 46, as described with reference to FIGS. 1, 2 and 4. The strain relief modules 46', 46" which directly adjoin or overlap an edge region of the wound reels are activated during winding. They are therefore in a position in which the wound reel, which is to be provided with strain relief, is supported. In an advantageous embodiment, the strain relief modules 46', 46" are pressed against the respective wound reel with a lower pressing force for reducing the loading of the wound reel edge regions. The magnitude of the pressing force can be selected, and preferably adjusted, as a function of the respective overlap of the strain relief module 46', 46". It is therefore possible here, and also in the embodiment of FIG. 4, to press the strain relief modules 46', 46" against the wound reel with only a relatively small pressing force so that the modules make only a very small contribution to the support.

Figure 6:
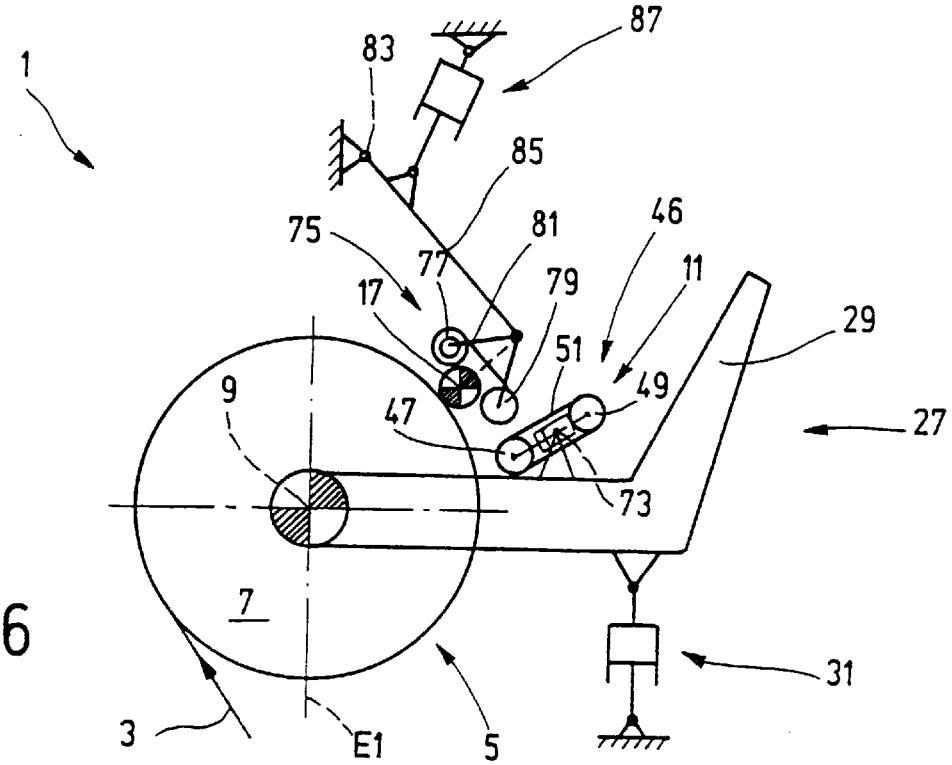
Figure 7:
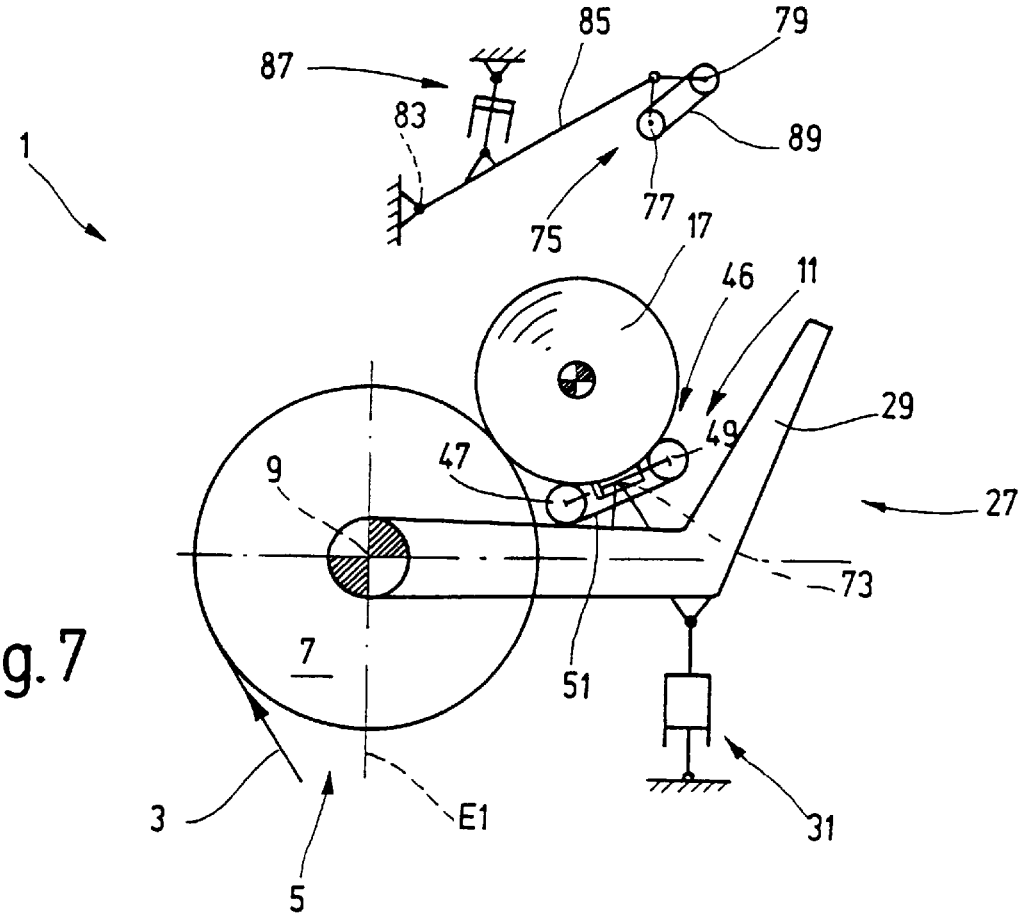

FIGS. 6 and 7 are schematic cross sections showing a functional sequence of a further embodiment of the winding machine 1. Identical parts are provided with identical reference numbers, as in preceding Figures. In FIGS. 6 and 7, the pivot axis of the lowering device 27 coincides with the longitudinal axis 9 of the supporting roller 7 of the first supporting device 5. This provides a particularly simple and space saving design of the winding machine 1. It is also possible for the pivot axis or axes of the lowering device 27, which is designed as a longitudinal bar 29, to be aligned with the longitudinal axis 9 of the supporting roller 7. The strain relief module 46 is designed as a rocker which can rotate about its axis of rotation 73 and which is not assigned an actuator drive in this embodiment. The strain relief module 46 is rotated automatically, and more details of that appear below. The second supporting device 11, which is described with reference to FIGS. 6 and 7, may be formed by a plurality of strain relief modules 46 arranged on the lowering device 27. In the illustrated example, there is only one strain relief module 46, which extends essentially over the entire width of the winding machine 1.

A loading device is arranged above the supporting device 5 and 11. It comprises two loading rollers 77 and 79, about which at least one loading belt 81 is guided. The loading device 75 is pivotally mounted at one end of a pivot lever 85 which is pivotable about an axis 83. The pivot lever 85 can be pivoted in either the clockwise or counter clockwise directions by a drive 87 which is indicated as a piston/cylinder unit. In FIG. 6, during winding on, the loading device 75, particularly a belt section 89 between the loading rollers 77, 79, is pressed with a prescribed force against the wound reel 17 bearing against the supporting roller 7 of the first supporting device 5 by the clockwise pivoting of the pivot lever 85. The strain relief module 46 arranged on the lowering device 27 is located in the first functional position here. As the winding process proceeds, the diameter of the wound reel 17 increases. Starting from a specific reel diameter, for example a diameter of 600 mm, the wound reel 17 is supported, or provided with strain relief, by the strain relief module 46, as in FIG. 7. The loading device 75 is then no longer required and is pivoted away, since the force in the nip between the belt section 89 and the wound reel 17 can now be controlled with the aid of the actuator drive 31 assigned to the lowering device 27. The wound reel 17 is supported over a circumferential area during the rest of the winding process, during which its weight is increasingly taken up by the strain relief module 46.

In order to move out the finished wound reel 17, which can have a diameter of 1800 mm or more, the lowering device 27 is pivoted clockwise. This moves the strain relief module 46 into its second functional position by tilting about the axis of rotation 73. Tilting of the strain relief module 46 clockwise supports moving out of the finished wound reel 17, starting from a specific angle of inclination of the supporting wall 71 with respect to the delivery surface (not illustrated). The finished wound reels roll out of the lowering device 27 automatically.

In another embodiment of the winding machine 1 illustrated in FIGS. 6 and 7, the strain relief module 46 may have a separate actuator drive for adjusting the magnitude of the pressing force of the strain relief module against the wound reel, and for thus adjusting the strain relief. It is therefore possible for the strain relief module 46, or one of the supporting rollers 47, 49, and the lowering device 27 to be moved separately from one another. It is possible, for example, for the strain relief module 46 to have an actuator drive which acts on the center of rotation of the supporting roller 49 and pivots the strain relief module 46 about the axis of rotation 73 or about the axis of rotation 56 of the supporting roller 47. As a result, the strain relief module 46 can be pivoted against a stop, in order to receive the wound reel, for example. During the winding process, the actuator drive can be deactivated so as to not influence the winding forces, while supporting the wound reel. During the winding process, the actuator drive can be employed for damping vibrations of the wound reel, for example. As a result of the separate actuator drive, the strain relief module 46 can be moved into the second functional position by pivoting it about the axis of rotation 73. As a result, the wound reel 17 can move out from the lowering device 27 which is pivoted clockwise.

A further winding station, which comprises a loading device 75 and a second supporting device 11 may be provided on the left-hand side of the supporting roller 7, so that wound reels can be rolled on both sides of the centrally arranged supporting roller 7.

The term "reel cores" covers both those which have a drum shaped base body and also so called reel hubs which comprise a base body composed of solid material. As described above, the reel cores can each be held by one separate guide device for enabling defined control of the winding process of each individual wound reel. In addition the reel cores may be driven, providing an additional possible way of influencing the winding quality.

All the above shows that the second supporting device 11 or the strain relief module can be formed merely by one supporting roller, carrying roller, or the like. In addition, a plurality of carrying rollers which are arranged on the lowering device of the winding machine may form the strain relief module. It is possible to assign an actuator drive 31 to each strain relief module.

In summary, the winding machine 1 can be simplified by arranging the second supporting device 11 on the lowering device 27. By use of a strain relief module which comprises at least two supporting rollers and at least one supporting belt which is guided around the rollers, it is possible to provide the wound reel with strain relief over a circumferential area, enabling the winding result to be improved.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A winding machine for winding a material web onto at least one reel core for forming at least one wound reel, the winding machine comprising:

a first wound reel supporting device comprising a first supporting roller;

a second wound reel supporting device comprising at least a second supporting roller;

at least one lowering device associated with the second supporting device, the lowering device being moveable between a first lowering position supporting the wound reel at the first supporting roller and a second lowering position enabling the wound reel to move out away from the first supporting device and out of the winding machine;

the second supporting device being moveable between at least two functional positions and including a support element thereon which in a first one of the two functional positions supports the winding process and in a second one of the two functional positions provides support to the wound reel over a circumferential area greater than a linear contact area during the rest of the winding on of the reel;

the second supporting device being included in the lowering device for being moveable with the lowering device between the first and second lowering positions, whereby the second supporting device does not interfere with the moving outward of the wound reel.

2. The winding machine of claim 1, wherein the first roller has a longitudinal axis; the lowering device is supported on the machine to be pivotable between the first and second lowering positions about an axis running essentially parallel to the longitudinal axis of the first roller.

3. The winding machine of claim 1, wherein the second supporting device comprises a strain relief module shaped and positioned for being moved into engagement with the wound reel over the circumferential area of the reel.

4. The winding machine of claim 3, wherein the strain relief module comprises at least two supporting rollers and at least one continuous supporting belt guided around the supporting rollers for contacting the circumference of the wound reel.

5. The winding machine of claim 4, wherein the strain relief module includes an actuator drive for moving at least one of either of the supporting rollers of the second supporting device or the supporting belt section that lies between the rollers toward and against the wound reel for providing support to the reel.

6. The winding machine of claim 5, further comprising a tension device at the strain relief module connected with at least one of the supporting rollers for adjusting the distance between the rotation axes of the supporting rollers and thereby adjusting the tension of the belt of the strain relief module.

7. The winding machine of claim 5, wherein at least one of the supporting rollers of the strain relief module or the supporting belt thereof is driveable to move the belt around the guide rollers in a continuous belt path.

8. The winding machine of claim 5, wherein a first one of the supporting rollers of the strain relief module is closer to the first supporting roller than the other second one of the supporting rollers of the strain relief module;

a bearing device connecting the first supporting roller to the lowering device;

the second supporting roller of the strain relief module being pivotable about the axis of rotation of the first supporting roller for moving the strain relief module between the positions thereof, and a device for pivotally moving the second supporting roller.

9. The winding machine of claim 5, wherein the strain relief module is supported on the lowering device by an axis of rotation of the module that is lying between the supporting rollers of the strain relief module, whereby the strain relief module is rotatable between the positions thereof around the rotation axis thereof.

10. The winding machine of claim 5, wherein the second supporting device comprises at least two of the strain relief modules at respective locations along the axis of the winding machine and the axis of the first support rollers.

11. The winding machine of claim 10, wherein the at least two strain relief modules are supported to be activated and deactivated independently or jointly.

12. The winding machine of claim 5, further comprising a drive for the wound reel.

13. The winding machine of claim 4, wherein the lowering device comprises a longitudinally extending bar extending over the direction of the axis of the winding machine, wherein in the first lowering position of the lowering device, the bar prevents the wound reel from rolling off the and moving out from the first supporting device and in the second lowering position of the lowering device, the bar being out of the way of the wound reel moving out from the first supporting roller.

14. The winding machine of claim 13, wherein the lowering device has a pivot axis that runs essentially parallel to the longitudinal axis of the first supporting roller of the first supporting device, and the lowering device pivots around the pivot axis the lowering device.

15. The winding machine of claim 14, wherein the pivot axis of the lowering device coincides with the longitudinal axis of the first supporting roller of the first supporting device.

16. The winding machine of claim 4, further comprising a drive for the wound reel.

17. The winding machine of claim 4, further comprising a tension device at the strain relief module connected with at least one of the supporting rollers for adjusting the distance between the rotation axes of the supporting rollers and thereby adjusting the tension of the belt of the strain relief module.

18. The winding machine of claim 4, wherein a first one of the supporting rollers of the strain relief module is closer to the first supporting roller than the other second one of the supporting rollers of the strain relief module;

a bearing device connecting the first supporting roller to the lowering device;

the second supporting roller of the strain relief module being pivotable about the axis of rotation of the first supporting roller for moving the strain relief module between the positions thereof, and a device for pivotally moving the second supporting roller.

19. The winding machine of claim 4, wherein the strain relief module is supported on the lowering device by an axis of rotation of the module that is lying between the supporting rollers of the strain relief module, whereby the strain relief module is rotatable between the positions thereof around the rotation axis thereof.

20. The winding machine of claim 4, wherein the second supporting device comprises at least two of the strain relief modules at respective locations along the axis of the winding machine and the axis of the first support rollers, and the at least two strain relief modules are supported to be activated and deactivated independently or jointly.

21. The winding machine of claim 4, further comprising a drive for the wound reel.

* * * * *